US005855494A

United States Patent [19]

Blaszczyk et al.

[11] Patent Number: 5,855,494

[45] Date of Patent: Jan. 5, 1999

[54] APPARATUS AND METHOD FOR ELECTRICALLY CONNECTING A PLURALITY OF ELECTRONIC MODULES

[75] Inventors: Marion Blaszczyk, Palos Hills; Dane L. Greives, Arlington Heights, both of Ill.

[73] Assignee: 3 Com Corp., Rolling Meadows, Ill.

[21] Appl. No.: 851,723

[22] Filed: May 5, 1997

[51] Int. Cl.[6] ..... H01R 11/00

[52] U.S. Cl. ..... 439/502; 361/735

[58] Field of Search ..... 439/502, 505, 439/651, 652, 638; 307/91; 361/744, 735

[56] References Cited

U.S. PATENT DOCUMENTS

| | | | |
|---|---|---|---|
| 1,767,262 | 6/1930 | Schmitz | 439/652 |
| 4,602,164 | 7/1986 | Gore, III et al. | 307/91 |
| 4,718,858 | 1/1988 | Godfrey et al. | 439/296 |
| 4,866,572 | 9/1989 | Blodgett | 361/744 |
| 5,507,668 | 4/1996 | Lambrinos et al. | 439/638 |

OTHER PUBLICATIONS

IBM Technical Disclosure Bulletin, vol. 34, No. 7B, pp. 403, 404, Dec. 1991.

*Primary Examiner*—Neil Abrams
*Assistant Examiner*—Javaid Nasri
*Attorney, Agent, or Firm*—Brinks Hofer Gilson & Lione

[57] ABSTRACT

An apparatus and method for electrically connecting a plurality of electronic modules includes a power cord for supplying power to a plurality of electronic modules, the power cord including a first end and a second end, the first end of the power cord including a plug for connection to a power source, the second end of the power cord including a power cord terminal, the power cord terminal including a first receptacle for connection to a first electronic module and a second receptacle, and a connector cord including a first end and a second end, the first end of the connector cord including a plug for connection to the second receptacle of the power cord terminal, the second end of the connector cord including a connector cord terminal, the connector cord terminal including a first receptacle for connection to a second electronic module and a second receptacle.

21 Claims, 2 Drawing Sheets

22
18
19
14
17
16
20
N
24
L 4
4
18
24
23
19
14
16
20
17
22
5
28

5
18
14
16
19
17
20
22
N
L
28

38
34
35
30
33
32
N
L
44

7
34
44
7
32
57
35
33
30
38
37
8
40
36
8

34
32
35
33
30
29
38
N
40
L
39
36

APPARATUS AND METHOD FOR ELECTRICALLY CONNECTING A PLURALITY OF ELECTRONIC MODULES

FIELD OF THE INVENTION

The present invention relates generally to the field of electrical connectors and, in particular, to an apparatus and method for supplying electricity to a plurality of electronic modules.

BACKGROUND OF THE INVENTION

Electronic modules are typically grouped together in a stacked configuration in a rack. The placement of these racks from an AC outlet may vary from several inches to several feet. Typically, each electronic module has its own power cord having a predetermined length, one end having a receptacle for connection to the input plug of the module, the other end having a plug for connection to an AC outlet. However, this arrangement has certain disadvantages. First, the individual power cords often become entangled because of the length and large number of cords being in close proximity to one another. Second, the position of the rack is limited by the length of each individual power cord. Finally, there are increased costs associated with having each power cord several feet in length.

Accordingly, it would be desirable to have a system for electrically connecting a plurality of electronic modules that overcomes the disadvantages described above.

SUMMARY OF THE INVENTION

According to a first aspect of the invention an apparatus for electrically connecting a plurality of electronic modules is provided comprising a power cord for supplying power to the plurality of electronic modules, the power cord including a first end and a second end, the first end of the power cord including a plug for connection to a power source, the second end of the power cord including a power cord terminal, the power cord terminal including a first receptacle for connection to a first electronic module and a second receptacle, and a connector cord including a first end and a second end, the first end of the connector cord including a plug for connection to the second receptacle of the power cord terminal, the second end of the connector cord including a connector cord terminal, the connector cord terminal including a first receptacle for connection to a second electronic module and a second receptacle.

According to a second aspect of the invention, a method of electrically connecting a plurality of electronic modules comprises the following steps: providing an apparatus for electrically connecting a plurality of electronic modules including a power cord for supplying power to the plurality of electronic modules, the power cord including a first end and a second end, the first end of the power cord including a plug for connection to a power source, the second end of the power cord including a power cord terminal, the power cord terminal including a first receptacle for connection to a first electronic module and a second receptacle, a connector cord including a first end and a second end, the first end of the connector cord including a plug for connection to the second receptacle of the power cord terminal, the second end of the connector cord including a connector cord terminal, the connector cord terminal including a first receptacle for connection to a second electronic module and a second receptacle; connecting the plug of the first end of the power cord to a power source; connecting the first receptacle of the power cord terminal to the first electronic module; connecting the plug of the first end of the connector cord to the second receptacle of the power cord terminal; and connecting the first receptacle of the connector cord terminal to the second electronic module, thereby electrically connecting the plurality of electronic modules.

According to a third aspect of the invention, an apparatus for electrically connecting a plurality of electronic modules is provided comprising a plurality of vertically stacked electronic modules, each of the modules including an identically configured input plug, the input plugs being vertically aligned; a power cord including first and second ends, the first end of the power cord including a plug for insertion into an AC outlet, the second end of the power cord including an integrally formed power cord terminal, the power cord terminal including first and second receptacles, the first and second receptacles of the power cord terminal each having a face substantially parallel to each other, the first receptacle of the power cord terminal connected to an input plug of a first electronic module; and a first connector cord including first and second ends, the first end of the first connector cord including a plug connected to the second receptacle of the power cord terminal, the second end of the first connector cord including a first connector cord terminal which is identical to the power cord terminal and includes first and second receptacles, the first receptacle of the first conductor cord terminal connected to the input plug of a second electronic module adjacent the first electronic module.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PRESENTLY PREFERRED EMBODIMENTS

Figure 2:
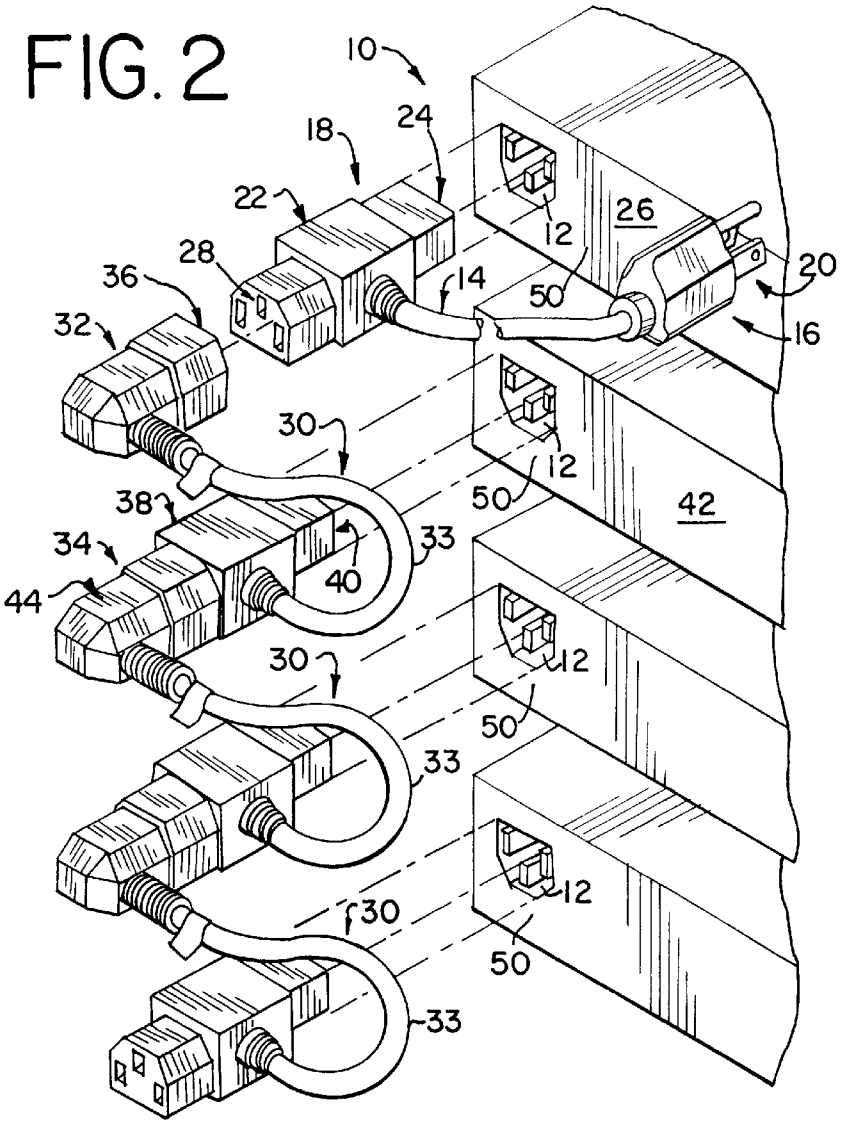
FIG. 2 is an exploded view of FIG. 1.
Figure 1:
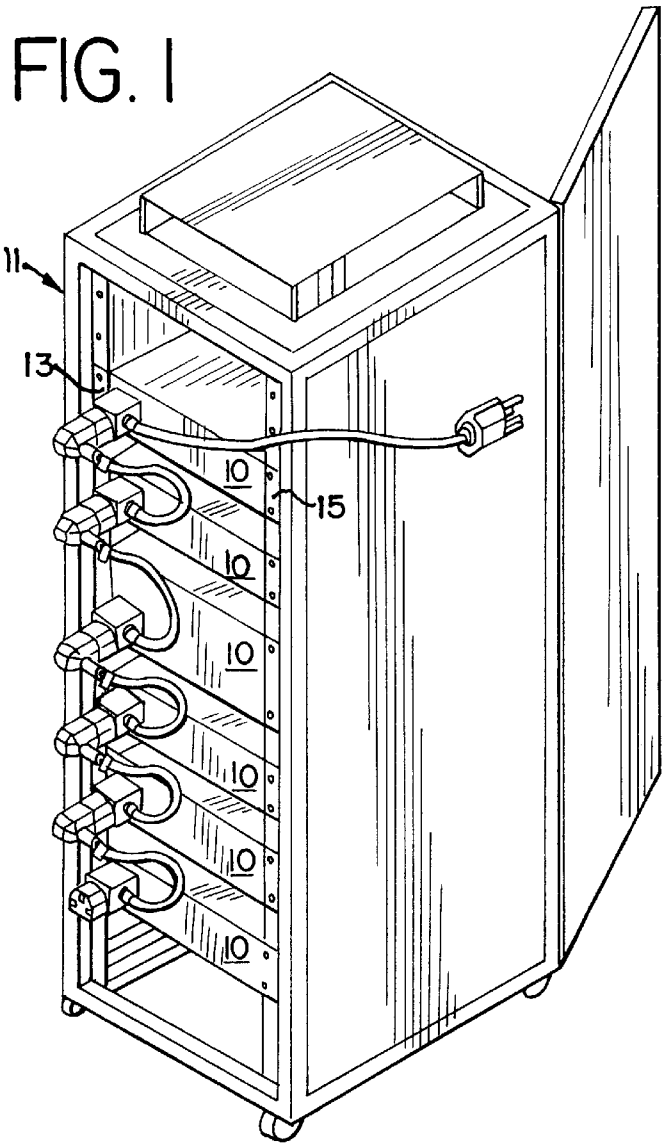
FIG. 1 is a perspective view of an apparatus for electrically connecting a plurality of electronic modules, which incorporates a presently preferred embodiment of this invention.

As shown in FIGS. 1 and 2, a plurality of electronic modules 10 may be stacked vertically in a rack 11. Alternatively, instead of being inserted into a rack 11, the electronic modules 10 may be stacked on the floor or on a desk top. The electronic modules 10 may include, for example, an office router, a port expansion device, a managed modem pool device, an access concentrator, a redundant power device, a LAN switch, an edgeserver, and other types of electronic modules. A typical application may include up to five stacked electronic modules 10 on a standard size rack. However, certain applications may require additional electronic modules 10 in a given rack. In an embodiment shown in FIGS. 1 and 2, each of the electronic modules 10 has an identically configured input plug 12 for receiving electricity.

As shown in FIGS. 1–2, a preferred embodiment of an apparatus for electrically connecting a plurality of electronic modules 10 includes a power cord 14 and a connector cord 30. The power cord 14 includes a first end 16 and a second end 18. The first end 16 of the power cord 14 includes a plug 20 for connection to a power source. The second end 18 of the power cord 14 includes a power cord terminal 22. The power cord terminal 22 includes a first receptacle 24 for connection to a first electronic module 26 and a second receptacle 28. The connector cord 30 includes a first end 32 and a second end 34. The first end 32 includes a plug 36 for connection to the second receptacle 28 of the power cord terminal 22. The second end 34 of the connector cord 30 includes a connector cord terminal 38. The connector cord terminal 38 includes a first receptacle 40 for connection to a second electronic module 42 and a second receptacle 44.

The apparatus of FIGS. 1–2 may be used for connecting a plurality of electronic modules. The plug 20 of the power cord 14 is connected to a power source (not shown). The first receptacle 24 of the power cord terminal 22 may be connected to, for example, the input plug 12 of a first electronic module 26. The plug 36 of the first end 32 of the connector cord 30 may be connected to the second receptacle 28 of the power cord terminal 22. The first receptacle 40 of the connector cord terminal 38 may be connected to the input plug 12 of a second electronic module 42.

Figure 4:
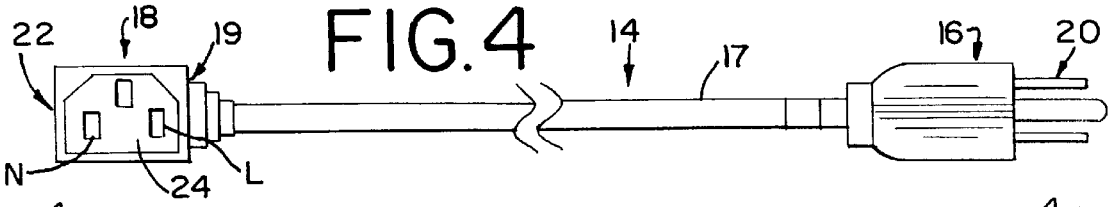
FIG. 4 is a back view of the power cord of FIG. 3.
Figure 3:
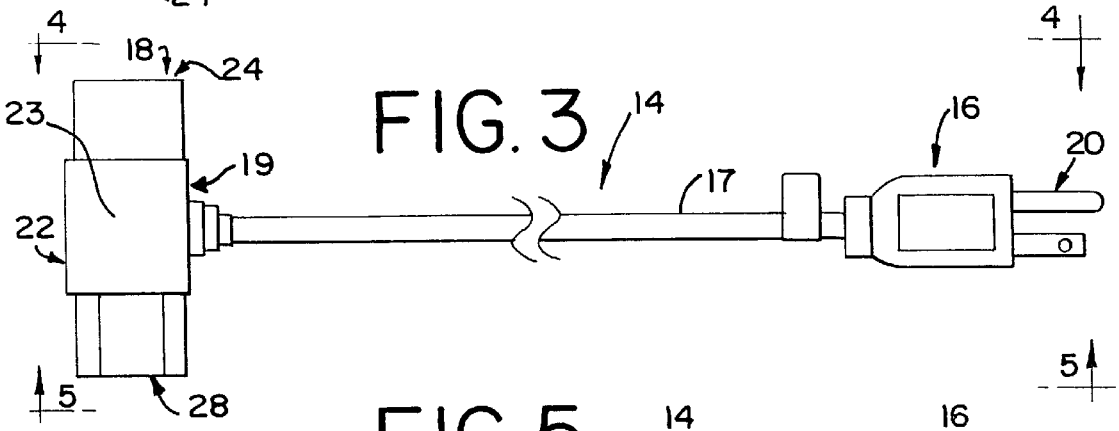
FIG. 3 is a top view of the power cord shown in the embodiment of FIGS. 1–2.
Figure 5:
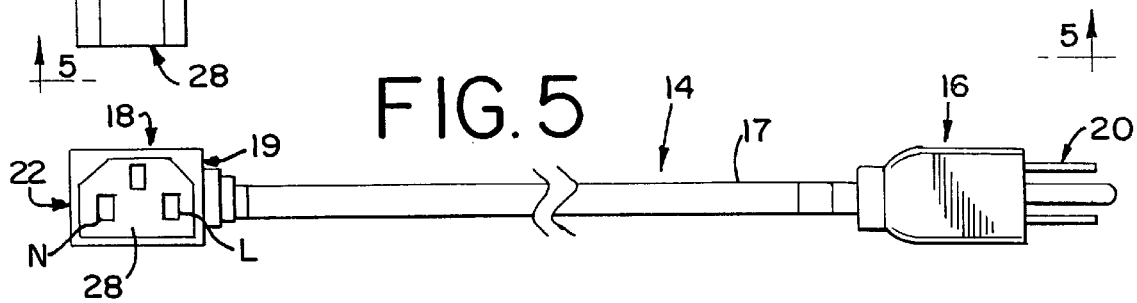
FIG. 5 is a front view of the power cord of FIG. 3.

FIGS. 3–5 show the power cord 14 which incorporates a presently preferred embodiment of this invention. The power cord 14 is merely a conductor for transmitting electricity from a power source to the plurality of electronic modules 10. The first end 16 and the second end 18 of the power cord 14 may be joined by a flexible cord portion 17. Flexible cord portion 17 may be any of the readily available, standard flexible cords suitable for transmitting electricity, including, for example, a UL style SJT 14 AWG/3C shielded black PVC jacketed cord or a 16 AWG/3C shielded neoprene jacketed cord. Alternatively, first end 16 and the second end 18 of the power cord 14 may be joined by other conventional means including, for example, a rigid conduit.

The first end 16 of the power cord 14 may be a standard, three prong plug 20 for connection to an AC outlet. In a preferred embodiment, the three prong plug 20 is not compatible with receptacles 24 and 28 of the power cord terminal 22 or receptacles 40 and 44 of connector cord terminal 38. The power cord terminal 22 may be formed of any rigid insulative material, including, for example, plastic. The flexible cord portion 17 may be permanently attached to the power cord terminal 22. For example, the flexible cord portion 17 may be permanently attached to a side 19 of the power cord terminal 22 and may extend substantially perpendicular from the power cord terminal 22. Alternatively, the flexible cord portion 17 may be permanently attached to a different side of the power cord terminal 22, including, for example, the top side 23 of the power cord terminal 22. The first receptacle 24 and the second receptacle 28 of the power cord terminal 22 may include any of the standard and readily available receptacles including, for example, an IEC-320 receptacle. In a preferred embodiment, conductive element N (neutral wire) of receptacle 24 is colinear with conductive element N (neutral wire) of receptacle 28. Similarly, conductive element L (line wire) of receptacle 24 is colinear with conductive element L (line wire) of receptacle 28. In a preferred embodiment, the face of receptacle 24 may be substantially parallel to the face of receptacle 28. The power cord 14 may be any length sufficient to provide electricity from an AC outlet to the first electronic module 26, including, for example, a length of approximately 7½ feet.

Figure 7:
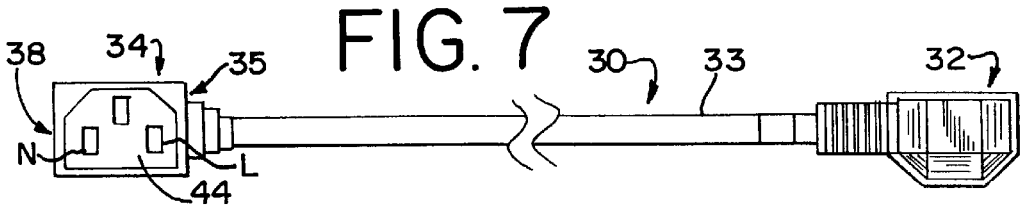
FIG. 7 is a back view of the connector cord of FIG. 6.
Figure 6:
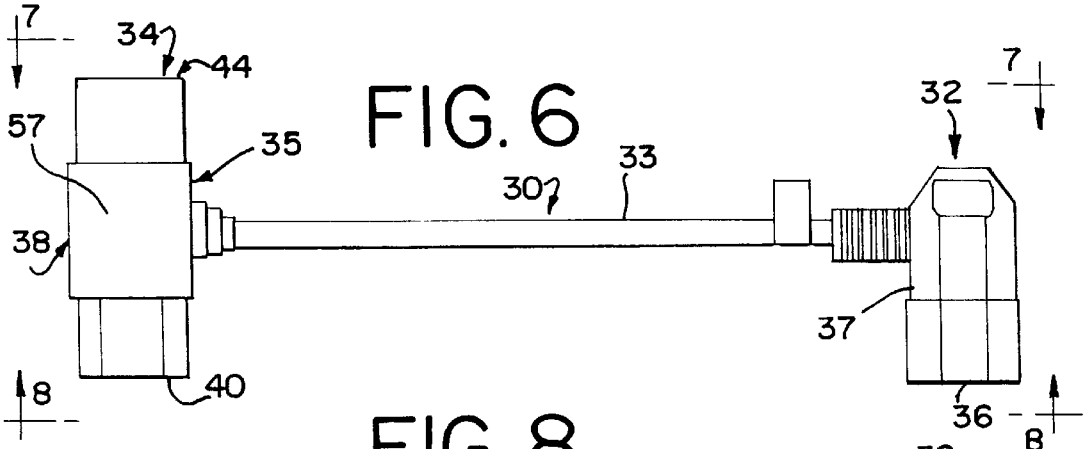
FIG. 6 is a top view of the connector cord shown in the embodiment of FIGS. 1–2.
Figure 8:
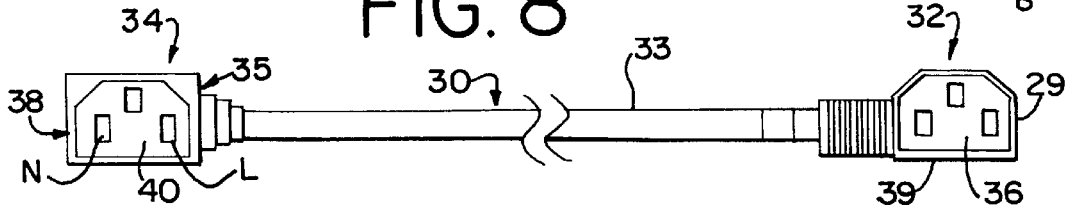
FIG. 8 is a front view of the connector cord of FIG. 6.

FIGS. 6–8 show the connector cord 30 which incorporates a presently preferred embodiment of this invention. The connector cord 30 is merely a conductor for transmitting electricity between electronic modules 10. The first end 32 and the second end 34 of the connector cord 30 may be joined by a flexible cord portion 33. Flexible cord portion 33 may be any of the readily available, standard flexible cords suitable for transmitting electricity, including, for example, a UL style SJT 14 AWG/3C shielded black PVC jacketed cord or a 16 AWG/3C shielded neoprene jacketed cord. Alternatively, first end 32 and the second end 34 of the connector cord 30 may be joined by other conventional means including, for example, a rigid conduit.

The connector cord terminal 38, in the preferred embodiment shown, may be formed of any rigid insulative material including, for example, plastic. The flexible cord portion 33 may be permanently attached to the connector cord terminal 38. For example, the flexible cord portion 33 may be permanently attached to a side 35 of the connector cord terminal 38 and may extend substantially perpendicular from the connector cord terminal 38. Alternatively, the flexible cord portion 33 may be permanently attached to a different side of the connector cord terminal 38, including, for example, the top side 57 of the connector cord terminal 38. As shown in FIGS. 1 and 2, the connector cord 30 preferably forms a U-shaped curve wherein the flexible cord portion 33 does not extend beyond the sides 13,15 of the electronic modules 10.

The first receptacle 40 and the second receptacle 44 of the power cord terminal 38 may include any of the standard and readily available receptacles including, for example, an IEC-320 receptacle. In a preferred embodiment, conductive element N (neutral wire) of receptacle 44 is colinear with conductive element N (neutral wire) of receptacle 40. Similarly, conductive element L (line wire) of receptacle 44 is colinear with conductive element L (line wire) of receptacle 40. In a preferred embodiment, the face of receptacle 44 is substantially parallel to the face of receptacle 40. The connector cord terminal 38 in the preferred embodiment may be identical to the power cord terminal 22.

The plug 36 of the first end 32 of the connector cord 30 may be recessed into housing 29. Housing 29 may be formed of any rigid insulative material including, for example, plastic. The flexible cord portion 33 may be permanently attached to the housing 29. For example, the flexible cord portion 33 may be permanently attached to a side 37 of the housing 29 and may extend substantially perpendicular from the housing 29. Alternatively, the flexible cord portion 33 may be permanently attached to a different side of the housing 29, including, for example, on the bottom side 39 of the housing 29. In a preferred embodiment, the plug 36 may include any of the standard and readily available plugs that is compatible with receptacle 28 of the power cord terminal 22 and receptacle and 44 of the connector cord terminal 38, including, for example, a reverse IEC-320 plug. The connector cord 30 may be constructed of any length sufficient to electrically connect an input plug 12 of one electronic module 10 to an input plug 12 of an adjacent electronic module 10, including, for example, a length of 6 inches.

In accordance with a preferred embodiment, as shown in FIGS. 1 and 2, the electronic modules 10 are vertically stacked on a rack 11. Each of the input plugs 12 of the electronic modules 10 is oriented the same way and is vertically aligned on the face plate 50 of the electronic modules 10. The different types of electronic modules 10 that may be used in any given rack 11 may vary in height including, for example, from about 2 to 5 inches, and as a result, the distance between the input plugs 12 of the electronic modules 10 may vary. One advantage of the invention is that a single connector cord 30 of fixed length will accommodate these varying distances between input plugs 12. Utilizing a connector cord 30 of uniform length reduces the number of components needed in the system and therefore greatly reduces costs.

There are a number of additional advantages of the present invention. The use of a single power cord 14 in combination with a much shorter connector cord 28 to provide power to a plurality of electronic modules 10 eliminates the need to have separate power cords for each electronic module 10. This greatly reduces the amount of the flexible cordage needed, and in turn, results in lower costs. Furthermore, utilizing the connector cord 30 to connect from one electronic module, for example electronic module 26, to an adjacent electronic module, for example electronic module 42, results in an uncluttered work area and eliminates the cable management problems associated with having separate power cords for each electronic module. For example, the connector cord 30 solves the problem associated with separate power cords becoming entangled due their length and large number. Moreover, the placement of the rack 11 is not limited by the length of each individual power cord, but instead is limited only by the single power cord 14. As a result, it is much easier to move the rack 11 from one position to another because of the single power cord 14 for the stacked electronic modules 10. Finally, the unique arrangement of the power cord 14 and the connector cord 30 has the advantage of allowing a technician to unplug one of the electronic modules 10 that needs to be removed from the rack 11 for servicing without disrupting power to the other electronic modules 10.

It should be appreciated that the embodiments described above are to be considered in all respects only illustrative and not restrictive. The scope of the invention is indicated by the following claims rather than by the foregoing description. All changes which comes within the meaning and range of equivalents of the claims are to be embraced within their scope.

We claim:

1. An apparatus for electrically connecting electronic modules comprising:

a first electronic module vertically stacked above a second electronic module, the first electronic module including a first recessed power input plug and the second electronic module including a second recessed power input plug wherein the first and second recessed power input plugs are identically configured, a power cord for supplying power to the first and second electronic modules, the power cord including a first end and a second end, the first end of the power cord including an integrally formed power plug for connection to a power source, the second end of the power cord including an integrally formed power cord terminal, the power cord terminal including a first receptacle engaged with the first recessed power input plug of the first electronic module and a second receptacle, the first receptacle of the power cord terminal having an orientation for receiving a plug which is different from an orientation of the second receptacle of the power cord terminal, a connector cord including a first end and a second end, the first end of the connector cord including an integrally formed plug recessed into a housing engaged with the second receptacle of the power cord terminal, the second end of the connector cord including an integrally formed connector cord terminal, the connector cord terminal including a first receptacle engaged with the second recessed power input plug of the second electronic module and a second receptacle, the first receptacle of the connector cord terminal having an orientation which is different from an orientation of the second receptacle of the connector cord terminal.

2. The apparatus of claim 1 wherein the orientation of the first receptacle of the power cord terminal comprises the orientation of the second receptacle of the power cord terminal inverted 180 degrees.

3. The apparatus of claim 1 wherein the orientation of the first receptacle of the connector cord terminal comprises the orientation of the second receptacle of the connector cord terminal inverted 180 degrees.

4. The apparatus of claim 3 further comprising a flexible cord having a first end and a second end, the first end attached to a side wall of the connector cord terminal and the second end attached to a side wall of the housing.

5. The apparatus of claim 2 further comprising a flexible cord having a first end and a second end, the first end attached a side wall of the power cord terminal and the second end attached to the power plug.

6. The apparatus of claim 4 wherein the flexible cord forms a U-shaped curve and wherein the flexible cord does not extend beyond side walls of the first and second electronic modules.

7. The apparatus of claim 1 wherein the power cord terminal and the connector cord terminal are identical.

8. The apparatus of claim 1 wherein the power plug of the first end of the power cord includes a standard three prong plug.

9. The apparatus of claim 1 wherein the power source includes an AC outlet.

10. The apparatus of claim 1 wherein the power cord terminal is comprised of a rigid, insulative material.

11. The apparatus of claim 1 wherein the connector cord terminal is comprised of a rigid, insulative material.

12. The apparatus of claim 1 wherein the power cord is approximately 7½ feet in length.

13. The apparatus of claim 1 wherein the connector cord is approximately 6 inches in length.

14. The apparatus of claim 1 wherein the first and second receptacles of the connector cord terminal each include openings for receiving a three prong plug, the openings of the first receptacle having a first orientation, the openings of the second receptacle having a second orientation which is different from the first orientation.

15. The apparatus of claim 14 wherein the first orientation is inverted 180 degrees from the second orientation.

16. An apparatus for electrically connecting a plurality of electronic modules comprising:

a plurality of vertically stacked electronic modules, each of the modules including an identically configured recessed power input plug, a power cord including first and second ends, the first end of the power cord including an integrally formed power plug for insertion into an AC outlet, the second end of the power cord including an integrally formed power cord terminal, the power cord terminal including first and second receptacles, the first receptacle of the power cord terminal engaged with a recessed power input plug of a first electronic module, a first connector cord including first and second ends, the first end of the first connector cord including an integrally formed plug recessed in a housing engaged with the second receptacle of the power cord terminal, the second end of the first connector cord including a first connector cord terminal, the first connector cord terminal including first and second receptacles, a flexible cord having a first end and a second end, the first end attached to a side wall of the housing and the second end attached to a side wall of the first connector cord terminal, the first receptacle of the first connector cord terminal engaged with a recessed power input plug of a second electronic module adjacent the first electronic module.

17. The apparatus of claim 16 wherein the first receptacle of the first connector cord terminal has an orientation which is different from an orientation of the second receptacle of the first connector cord terminal.

18. The apparatus of claim 16 further comprising a second connector cord including first and second ends, the first end of the second connector cord including an integrally formed plug recessed in a housing engaged with the second receptacle of the first conductor cord terminal, the second end of the second connector cord including a second connector cord terminal which is identical to both the power cord terminal and the first conductor cord terminal, the second connector cord terminal including first and second receptacles, the first receptacle of the second connector cord terminal engaged with a recessed power input plug of a third electronic module adjacent the second electronic module.

19. The apparatus of claim 16 wherein at least to two conductive elements of the first receptacle of the power cord terminal are colinear with at least two conductive elements of the second receptacle of the power cord terminal.

20. The apparatus of claim 16 wherein at least two conductive elements of the first receptacle of the first connector cord terminal are colinear with at least two conductive elements of the second receptacle of the first connector cord terminal.

21. A method of electrically connecting electronic modules comprising:

providing an apparatus for electrically connecting electronic modules including a first electronic module vertically stacked above a second electronic module, the first electronic module including a first recessed power input plug and the second electronic module including a second recessed power input plug wherein the first and second recessed power input plugs are identically configured, a power cord for supplying power to the first and second electronic modules, the power cord including a first end and a second end, the first end of the power cord including an integrally formed power plug, the second end of the power cord including an integrally formed power cord terminal, the power cord terminal including a first receptacle and a second receptacle, the first receptacle of the power cord terminal having an orientation which is different from an orientation of the second receptacle of the power cord terminal, a connector cord including a first end and a second end, the first end of the connector cord including an integrally formed plug recessed into a housing, the second end of the connector cord including an integrally formed connector cord terminal, the connector cord terminal including a first receptacle and a second receptacle, the first receptacle of the connector cord terminal having an orientation which is different from an orientation of the second receptacle of the connector cord terminal;

engaging the power plug of the first end of the power cord with a power source;

engaging the first receptacle of the power cord terminal with the first recessed power input plug of the first electronic module;

engaging the plug of the first end of the connector cord with the second receptacle of the power cord terminal; and, engaging the first receptacle of the connector cord terminal with the second recessed power input plug of the second electronic module, thereby connecting the first and second electronic modules.

* * * * *